United States Patent [19]

Viola et al.

[11] Patent Number: 4,768,358

[45] Date of Patent: Sep. 6, 1988

[54] SECURITY HANDLE LOCK

[76] Inventors: Robert Viola, 42-15 Layton St., Apt. 2D, Elmhurst, N.Y. 11373; George Spector, 233 Broadway Rm. 3815, New York, N.Y. 10007

[21] Appl. No.: 893,022

[22] Filed: Aug. 4, 1986

[51] Int. Cl.[4] ..... E05B 73/00; E05B 65/52

[52] U.S. Cl. ..... 70/14; 70/58; 70/65

[58] Field of Search ..... 70/58, 64, 65, 66, 14–19; 24/30.5 R; 119/128; 292/328–331; 16/224

[56] References Cited

U.S. PATENT DOCUMENTS

| | | | |
|---|---|---|---|
| 89,978 | 5/1869 | Everham | 16/224 |
| 263,212 | 8/1882 | Pettibone | 70/18 X |
| 407,625 | 7/1889 | Valdivielso | 70/65 X |
| 707,353 | 8/1902 | Post | 16/224 X |
| 1,307,966 | 6/1919 | Francis | 70/64 X |
| 1,455,119 | 5/1923 | Manock | 70/18 |
| 1,499,960 | 7/1924 | Alemdia | 70/17 X |
| 2,166,860 | 7/1939 | Davis | 70/65 |
| 2,324,638 | 7/1943 | O'Connor | 70/65 |
| 2,571,349 | 10/1951 | Eckles | 70/14 |
| 2,650,590 | 9/1953 | Moore et al. | 119/128 |
| 3,476,466 | 11/1969 | Hopkins | 16/224 X |
| 3,685,094 | 8/1972 | Goosev | 16/224 |
| 3,959,995 | 6/1976 | Fletcher | 70/58 X |

FOREIGN PATENT DOCUMENTS

| | | | |
|---|---|---|---|
| 335862 | 11/1919 | Fed. Rep. of Germany | 70/18 |
| 284799 | 4/1931 | Italy | 70/65 |
| 220064 | 6/1942 | Switzerland | 70/65 |

*Primary Examiner*—Gary L. Smith
*Assistant Examiner*—Suzanne L. Dino

[57] ABSTRACT

A security handle lock is provided and consists of a curved arm inserted through eyelets in a neck of a bag and a straight arm that has an eye portion at one end and pivots on other end with respect to the curved arm. The eye portion passes over end of the curved arm allowing a shackle of a padlock to be secured through a transverse aperture of the curved arm locking the neck of the bag closed and allowing the straight arm to act as a handle.

1 Claim, 1 Drawing Sheet

SECURITY HANDLE LOCK

BACKGROUND OF THE INVENTION

The instant invention relates generally to locking devices and more specifically it relates to a security handle lock for a bag.

Numerous locking devices have been provided in prior art that are adapted to secure open necks of bags into closed locked positions. For example, U.S. Pat. Nos. 1 062,506; 1,307,966 and 2,798,370 all are illustrative of such prior art. While these units may be suitable for the particular purpose to which they address, they would not be as suitable for the purpcses of the present invention as heretofore described.

SUMMARY OF THE INVENTION

A primary object of the present invention is to provide a security handle lock that will overcome the shortcomings of the prior art devices.

Another object is to provide a security handle lock that will close an open neck of any type of bag having holes in the neck.

An additional object is to provide a security handle lock that will make carrying the bag easier due to a built in handle structure.

A further object is to provide a security handle lock that is simple and easy to use.

A still further object is to provide a security handle lock that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
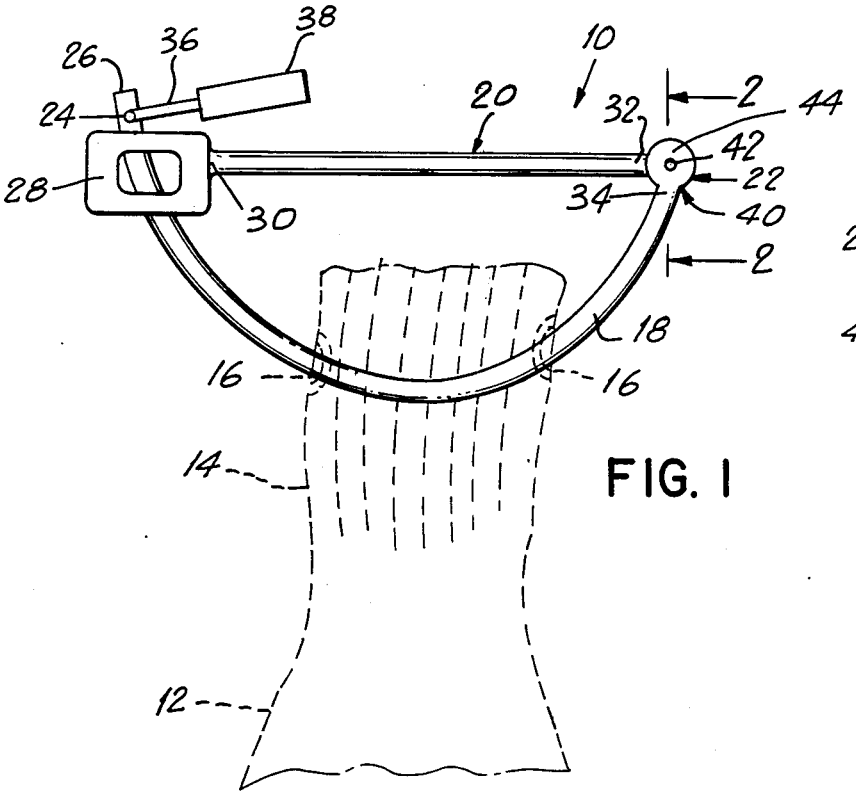
FIG. 1 is a side view of the invention in a locked position on a bag shown in phantom.
Figure 2:
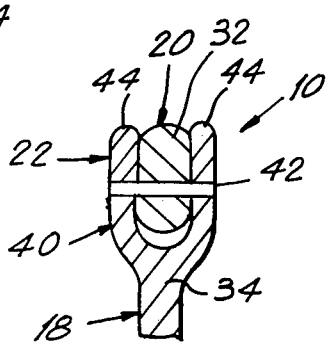
FIG. 2 is an enlarged cross sectional view taken along line 2—2 in FIG. 1 showing the joint in greater detail.
Figure 3:
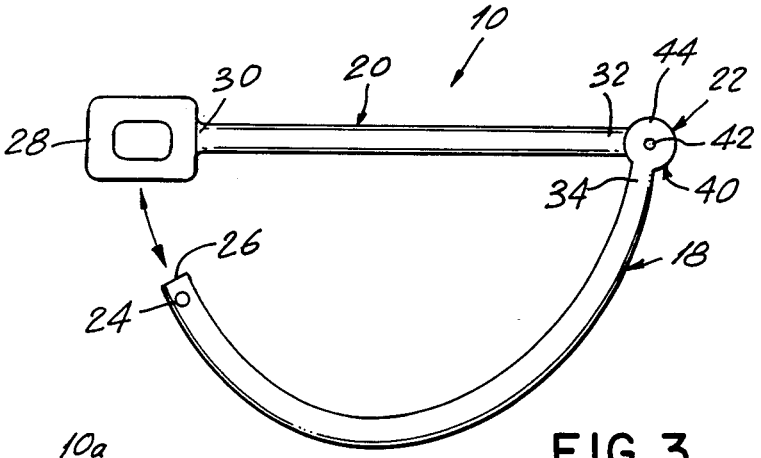
FIG. 3 is a side view thereof in an open position.

Turning now descriptively to the drawings, in which similar reference characters denote similar elements throughout the several views, FIGS. 1 through 3 illustrates a security handle lock 10 for a bag 12 shown in phantom that has a neck 14 with a pair of spaced apart eyelets 16 therethrough. The security handle lock 10 consists of a curved arm 18, a straight arm 20 and a pivoting structure 22. The curved arm 18 has a transverse aperture 24 at one end 26 and is inserted through the eyelets 16 in the neck 14 of the bag 12. The straight arm 20 has an eye portion 28 at one end 30.

The pivoting structure 22 is for pivoting other end 32 of the straight arm 20 with respect to other end 34 of the curved arm 18 so that the eye portion 28 of the straight arm 20 can pass over the transverse aperture 24 of the curved arm 18. A shackle 36 of a padlock 38 is secured through the transverse aperture of the curved arm locking the neck 14 of the bag 12 closed. The straight arm 20 acts as a handle in which the bag 12 can be carried thereby.

The pivoting structure 22 includes a forked end 40 on the curved arm 18 opposite the end 26 that has the transverse aperture 24. A pivot pin 42 is mounted between furcations 44 of the forked end 40 and through end 32 of the straight arm 20 opposite the eye portion 28.

Figure 4:
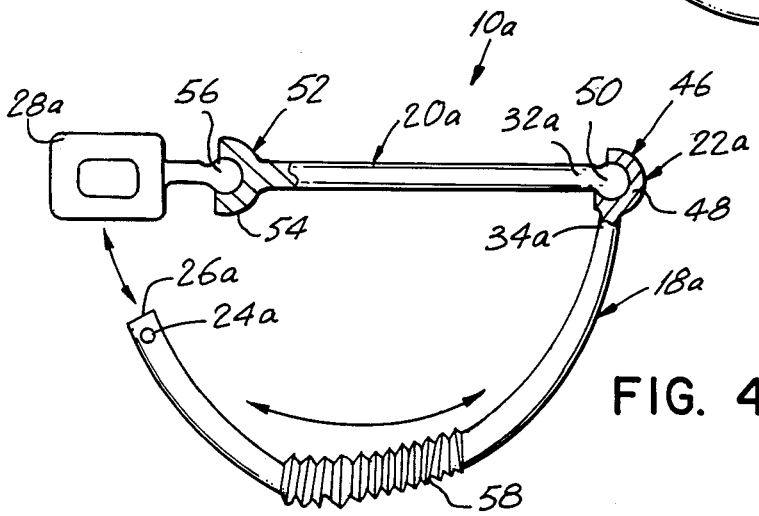
FIG. 4 is a side view of a modification in an open position having ball joints and a telescopic expandable section for different sized bags.

FIG. 4 shows a modified security handle lock **10*a* wherein the pivoting structure 22*a* is a ball joint 46 which includes a socket 48 on the curved arm 18*a* at end 34*a* opposite the end 26*a* that has the transverse aperture 24*a*. A ball 50 is formed on end 32*a* of the straight arm 20*a* opposite the eye portion 28*a*. The ball 50 is received within the socket 48. A second ball joint 52 is provided which includes a socket 54 and a ball 56 formed on the straight arm 20*a* adjacent the eye portion 28*a*. A telescopic expandable section 58 is formed midway on the curved arm 18*a* so as to accommodate various sized necks 14 of the bag 12**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A security handle lock for a bag having a neck with a pair of spaced apart eyelets therethrough, said security handle lock comprising:

(a) a curved arm having a transverse aperture at one end, said curved arm being adapted for insertion through said eyelets;

(b) a straight arm having an eye portion at one end;

(c) means for universally pivoting an other end of said straight arm with respect to other end of said curved arm so that said eye portrion of said straight arm can be readily positioned, to receive therethrough, said transverse aperture of said curved arm allowing a shackle of a padlock to be secured through said transverse aperture of said curved arm locking said neck of said bag allowing said straight arm to act as a handle by which said bag can be carried, thereby, wherein said pivoting means is a ball joint which includes:

(d) said curved arm having a socket opposite said end having said transverse aperture;

(e) a ball formed on the end of said straight arm opposite said eye portion, said ball received within said socket;

(f) a second ball joint which includes a socket and ball formed on said straight arm adjacent said eye portion, whereby said eye portion of said straight arm can be conveniently pivoted relative said straight arm to readily receive said curved arm end therethrough; and (g) an integral expandable bellows portion provided on said curved arm whereby said curved arm can be expanded to accommodate larger bags.

* * * * *